US008701900B2

(12) United States Patent
Childers et al.

(10) Patent No.: US 8,701,900 B2
(45) Date of Patent: Apr. 22, 2014

(54) COLLAPSIBLE STAND FOR MUSIC AMPLIFIER AND THE LIKE

(76) Inventors: Joshua M. Childers, Chuckey, TN (US); John R. E. Schramlin, Kingsport, TN (US)

( * ) Notice: Subject to any disclaimer, the term of this patent is extended or adjusted under 35 U.S.C. 154(b) by 52 days.

(21) Appl. No.: 13/506,424

(22) Filed: Apr. 18, 2012

(65) Prior Publication Data

US 2012/0325122 A1 Dec. 27, 2012

Related U.S. Application Data

(60) Provisional application No. 61/517,349, filed on Apr. 18, 2011.

(51) Int. Cl.

| | |
|---|---|
| ***A47F 7/00*** | (2006.01) |
| *A47B 43/00* | (2006.01) |
| *A47B 81/06* | (2006.01) |

(52) U.S. Cl.

USPC ..... 211/85.6; 211/195; 181/199

(58) Field of Classification Search

USPC ..... 248/441.1, 443, 444, 447, 454, 457, 248/460; 181/198, 199; 211/85.6, 189, 195

See application file for complete search history.

(56) References Cited

U.S. PATENT DOCUMENTS

| | | | | | |
|---|---|---|---|---|---|
| 2,357,214 | A * | 8/1944 | McDole | 312/235.4 |
| 2,598,128 | A * | 5/1952 | Liechty | 108/13 |
| 4,474,407 | A * | 10/1984 | Nazar | 297/188.13 |
| 4,846,346 | A * | 7/1989 | Kime | 206/372 |
| 5,664,756 | A * | 9/1997 | Liao | 248/443 |
| 6,349,792 | B1 * | 2/2002 | Smith et al. | 181/156 |
| 6,588,837 | B1 * | 7/2003 | Schultz et al. | 297/111 |
| 6,739,651 | B1 * | 5/2004 | Barefoot | 297/118 |
| 7,296,653 | B1 * | 11/2007 | Smith et al. | 181/155 |
| 7,900,773 | B2 * | 3/2011 | Irish | 206/557 |
| 8,038,109 | B2 * | 10/2011 | Ashford | 248/150 |

* cited by examiner

*Primary Examiner* — Jonathan Liu
*Assistant Examiner* — James Twomey

(57) ABSTRACT

A stand for supporting sound amplifiers, wherein the stand has a base for resting on a floor, an amplifier support platform on the base, the plane of said platform being slanted downwardly from front to rear, a back rest pivotally mounted on the base for pivoting between 0° and 90° to the plane of the platform, and cooperating stop means on the base and said back rest for stopping pivoting motion of the back rest beyond 90° to the plane of the platform, wherein the plane of the platform is below the plane of the back rest when the back rest is in a stored position lying adjacent the platform.

5 Claims, 7 Drawing Sheets

11B
11B

COLLAPSIBLE STAND FOR MUSIC AMPLIFIER AND THE LIKE

This application claims priority under 35 U.S.C. 119(e)(1) based on Applicants Provisional U.S. Patent Application Ser. No. 61/517,349 filed Apr. 18, 2011 of same title.

FIELD

The present invention resides in the field of support structures, e.g., stands for musical items such as amplifiers, electronic control heads, or the instruments themselves such as guitars or the like stringed instruments.

PRIOR ART

It is customary in many situations to simply place music amplifiers directly on the floor of a performance stage or on a table for elevating and positioning the amplifier. Such methods are subject to creating or picking up interference sounds which are then picked up by the amplifier itself and transmitted to the audience. These sounds can be generated, e.g., by vibrations of the performance auditorium floor which acts as a giant drum head, particularly during loud musical playing. Various types of stands for musical equipment have been devised but they have disadvantages such as enhancing interference sounds, or are structured in a heavy, bulky or difficult to deploy manner.

Various stand structures have also been proposed such as shown in U.S. Pat. Nos. 4,753,408; 7,296,653; 6,349,792; 5,190,254; 5,024,407; 7,264,216; 5,161,771; Des. 247,034; Des. 268,108; Des. 212,238; U.S. Pat. No. 2,598,128; US 2011/0017886 A1; and U.S. Pat. No. 3,913,877. These structures have not been found satisfactory in regard to one or more aspects of visual appearance, physical strength, ease of transport, ease of set up, vibrational sound pick up resistance, or the like.

SUMMARY OF THE PRESENT INVENTION

The present invention avoids or minimizes the above noted disadvantages by means of a stand which is light weight, visually attractive, and of marked utility for supporting an amplifier or like musical equipment and attendant electronic devices, wherein the stand comprises a base having a pair of side members providing a pair of front legs and a pair of shorter rear legs and supporting (1) a forward substantially planar platform which is slanted from front to rear, and (2) a rearward spanner member, a back rest pivotally mounted on the side members for being pivoted from a closed (stored) position adjacent the top of the platform to an open operative position at substantially 90° to the platform, cooperating stop means on the spanner member and the back rest for positioning the back rest in its open operative position, and wherein all of the floor contacting leg ends terminate in a line surface whereby transmission to the stand and to an amplifier thereon of sound waves emanating from a floor are minimized. The various parts of the present stand are preferably of artistically crafted and finished hardwoods.

BRIEF DESCRIPTION OF THE DRAWINGS

The invention will be understood further from the drawings and their detailed description wherein.

DETAILED DESCRIPTION OF THE DRAWINGS

Figure 1:
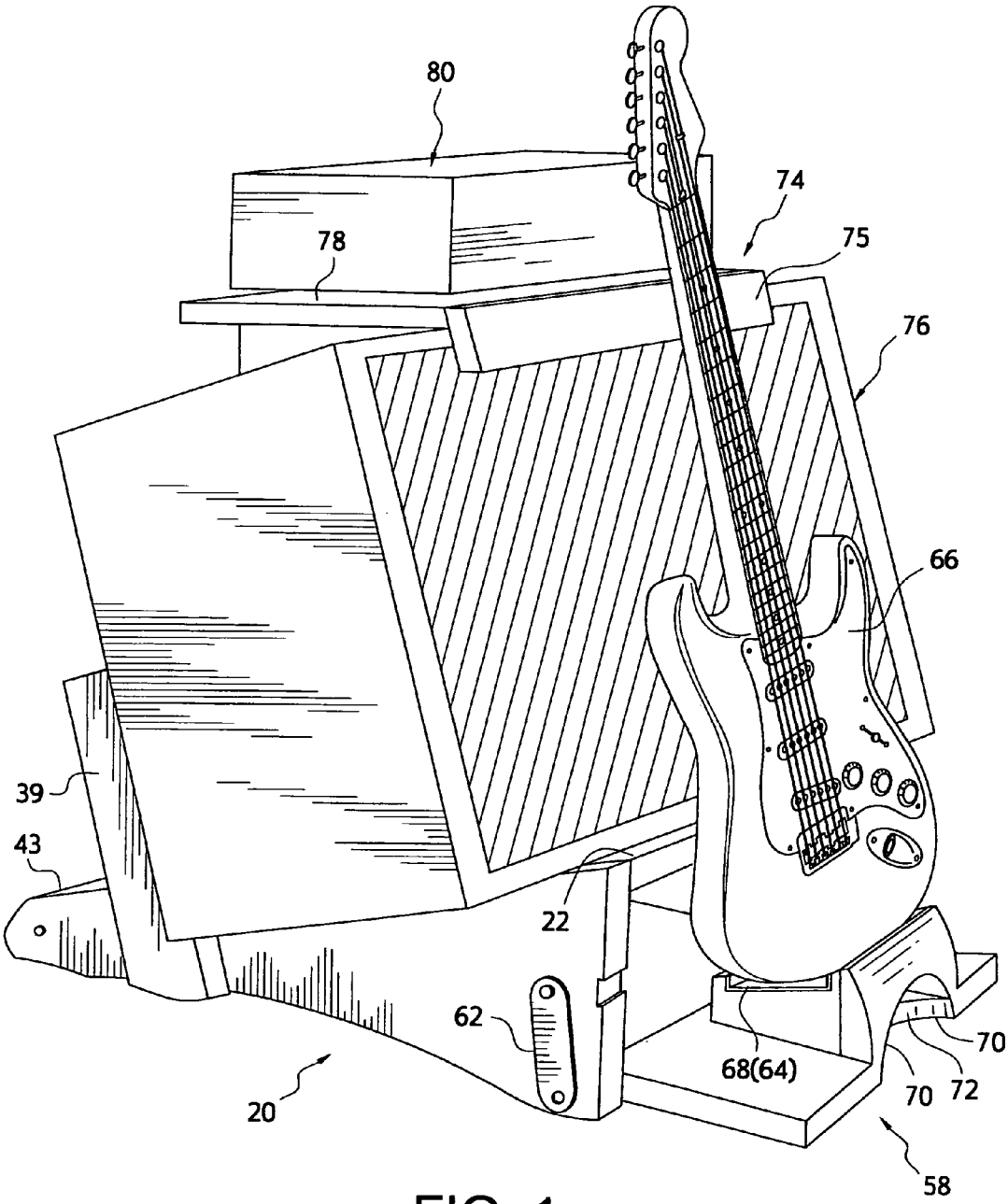
FIG. 1 is perspective view of a preferred embodiment of the present stand and showing an amplifier and electronic control head, and a guitar in a stand-by position thereon.
Figure 3:
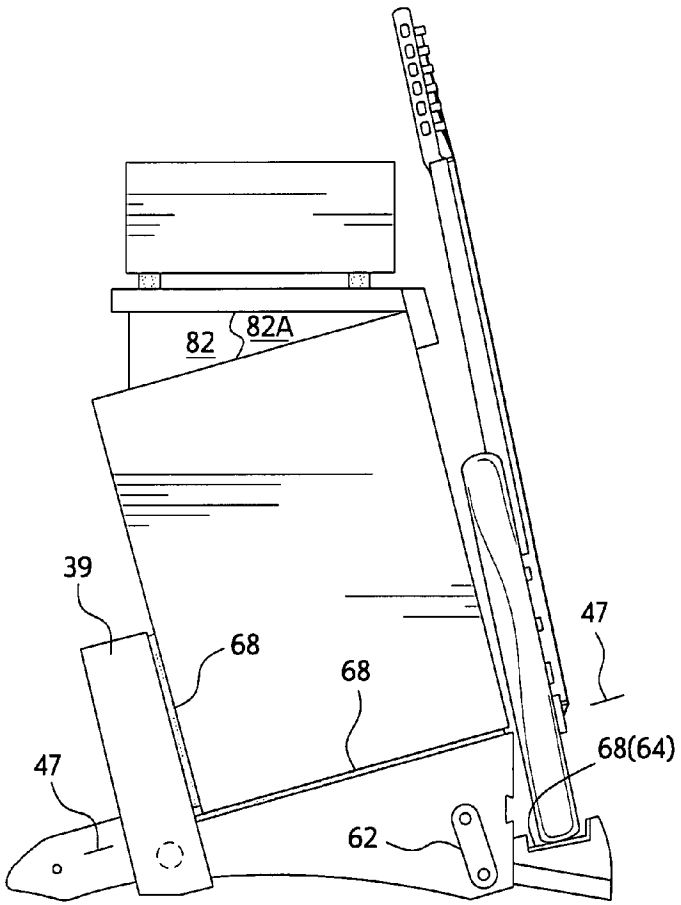
FIG. 3 is a side view of FIG. 1.
Figure 2:
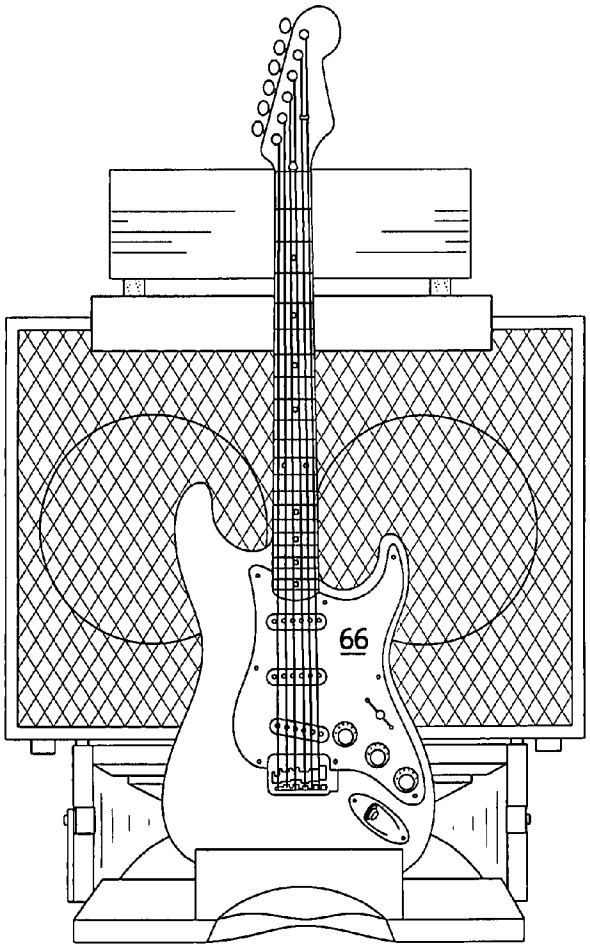
FIG. 2 is a front view of FIG. 1.
Figure 4:
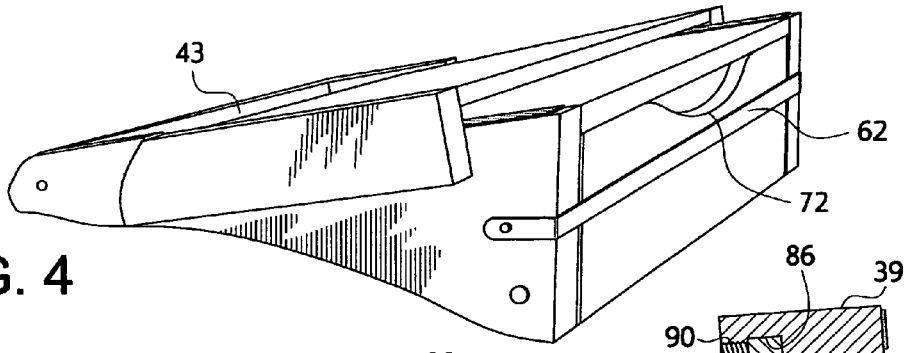
FIG. 4 is a perspective folded-up view of the present stand.

Referring to the drawings the present stand comprises a base 20 having a substantially planar platform 22 having front 24, rear 26 and side 28 edges and downwardly depending sides 30,31 affixed to the side edges of the platform 22, wherein a front portion 32 of each side provides a front leg, wherein a rear portion 34 each side provides a rear leg, and wherein the bottom of each leg is shaped to provide a lateral line contact ridge 35 with a floor 36, to minimize sound wave transmission from the floor to the stand and to an amplifier thereon and wherein a longitudinal central portion of the bottom edge of each side is recessed upwardly to provide gaps 41 which further prevents reinforcing of unwanted sound waves. The stand further has a rearward spanner member 43 and a substantially rectangular back rest 38 having side supports 39 with side portions 40 extending downwardly from a lateral portion 42 of the back rest to provide pivot sections. Cooperating pivot bearing 44 and pivot shaft 46 means on each pivot section and on a rear portion of an adjacent side of the base respectively allows the back rest to pivot forwardly to a downwardly closed (stored) position adjacent the platform and to pivot upwardly and rearwardly to a substantially vertical, i.e., right angle position relative to the plane 47 of the platform. Cooperating stop shoulders 48 on said spanner member and 50 on the lateral portion 42 of the back rest 38 are provided for stopping the back rest in said substantially right angle position with respect to plane 47 of the platform.

Figure 6:
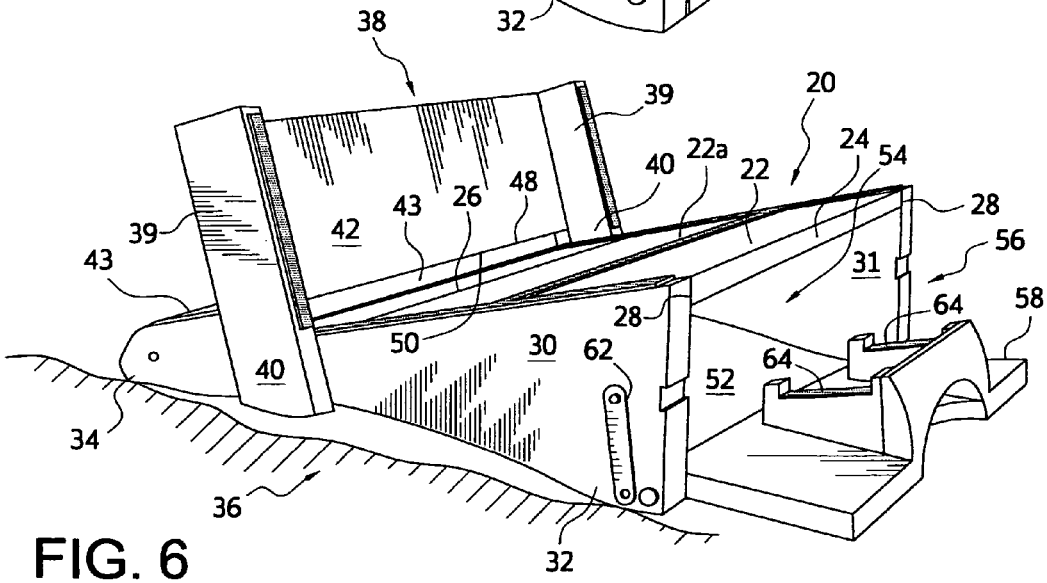
FIG. 6 is a view as in FIG. 5 with the front storage compartment door in its open position.
Figure 8:
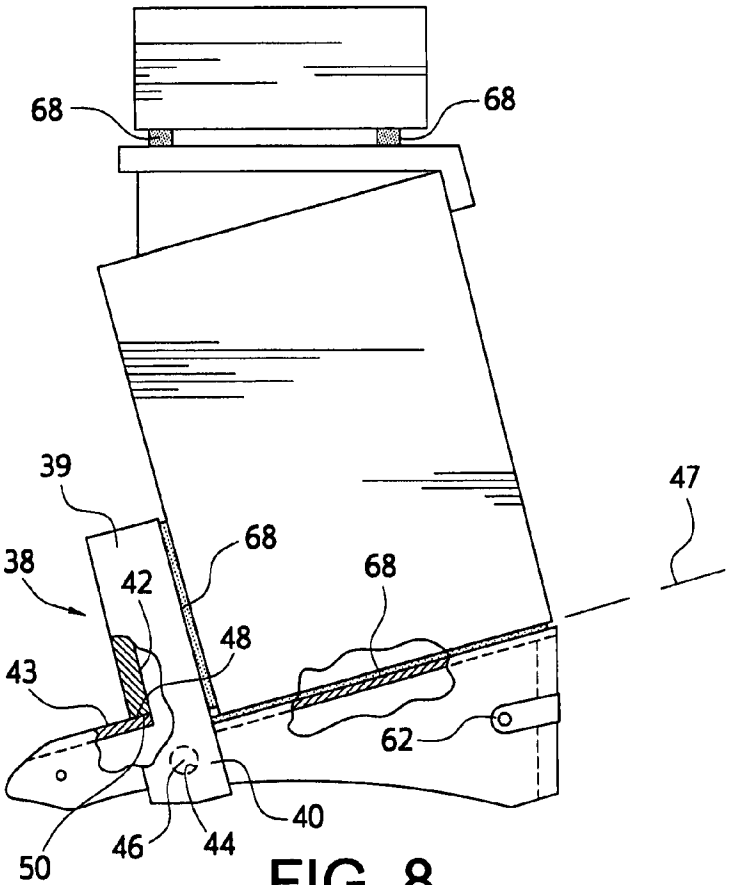
FIG. 8 is a side view of FIG. 7 with portions broken away for clarity.
Figure 7:
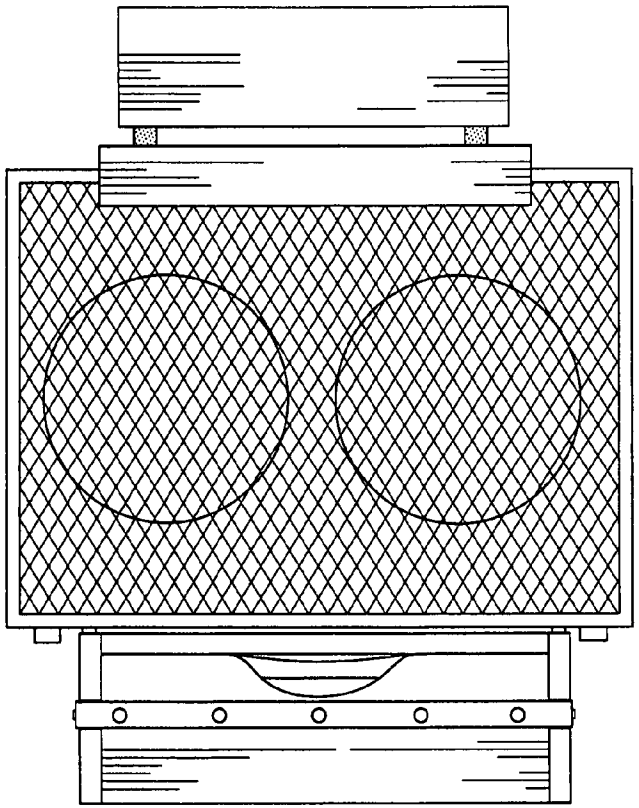
FIG. 7 is a front view as in FIG. 2 without a guitar and with the storage compartment door secured by straps in the closed position of the door.
Figures 9, 9A, 10, 10A, 11, 11A, 11B:
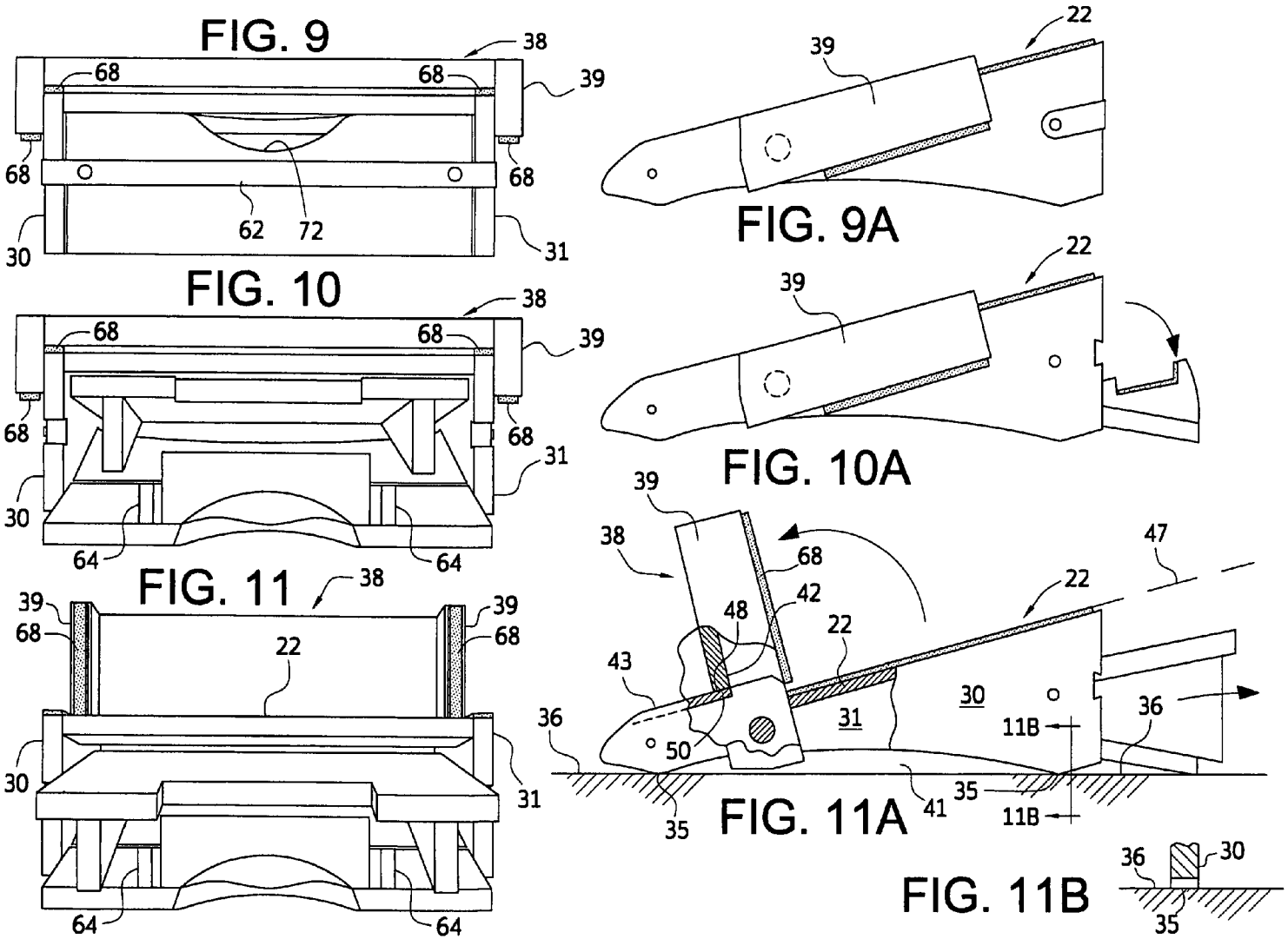
FIGS. 9 and 9A are front and side views of the present closed-up stand.
FIGS. 10 and 10A are front and side views of the present stand with the storage compartment front door in its open position.
FIGS. 11 and 11A are front and side views of the present stand showing the table top partially extracted from the storage compartment.
FIG. 11B is a cross-sectional view taken along line 11B-11B in FIG. 11A and showing further details of the "line contact" of the stand legs with a stage floor.
Figure 12A:
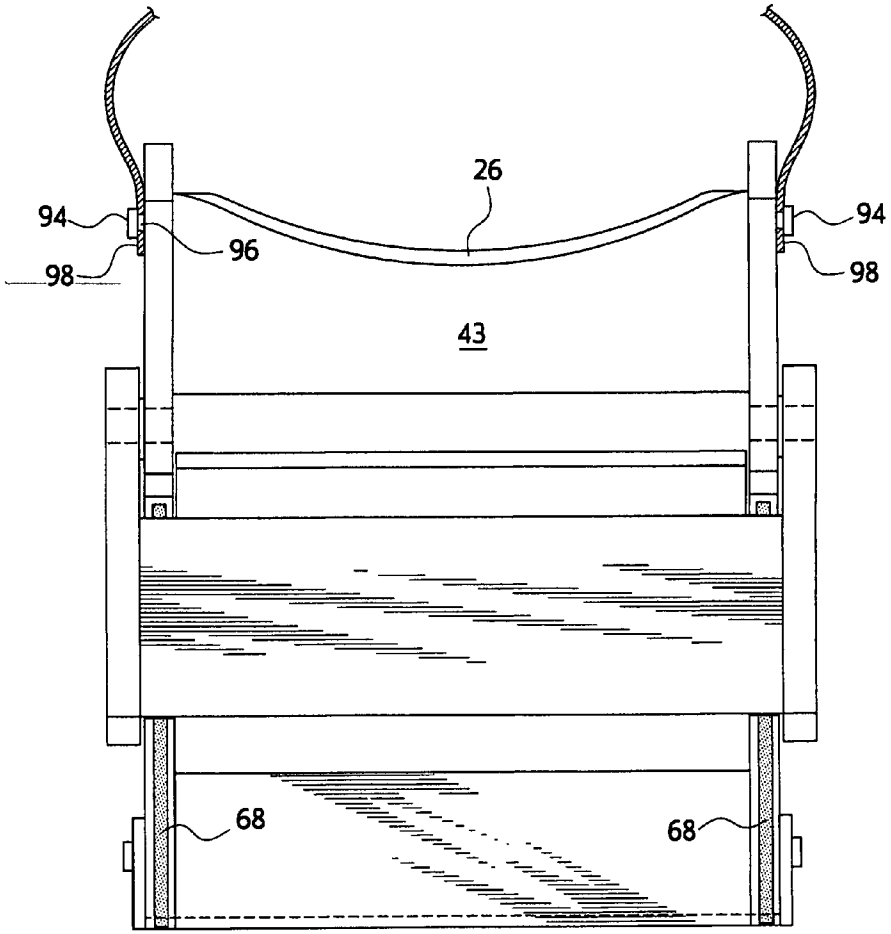
FIGS. 12 and 12A are side and top views of the present folded and strapped stand in transport position.
Figure 12:
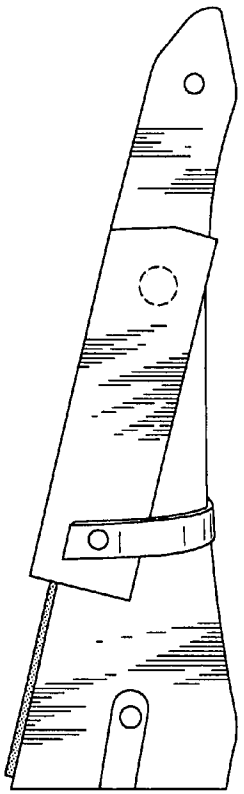
Figure 13:
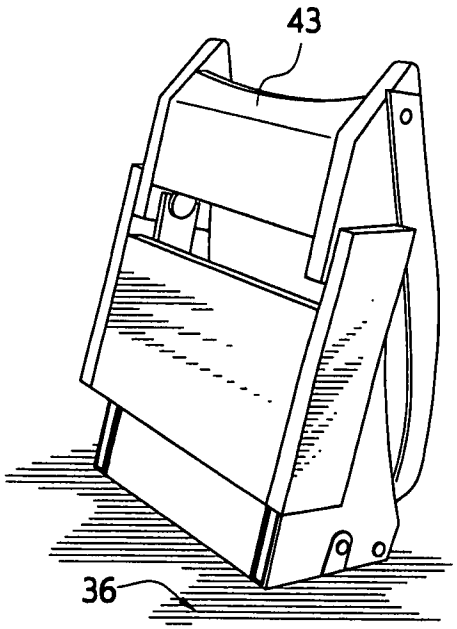
FIG. 13 is a perspective view of the present stand in its stand-up position on a floor and provided with an over the shoulder carrying strap.
Figure 15:
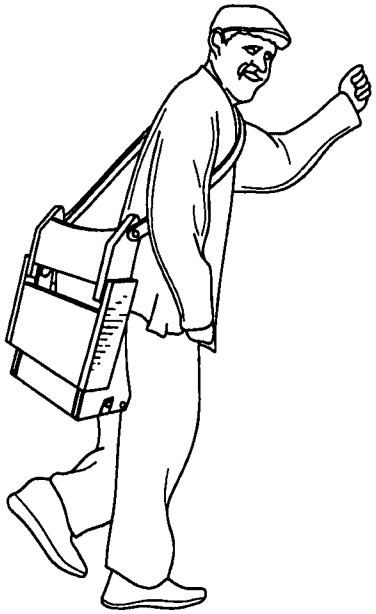
FIG. 15 shows the present stand being shoulder carried by the shoulder strap.
Figure 14:
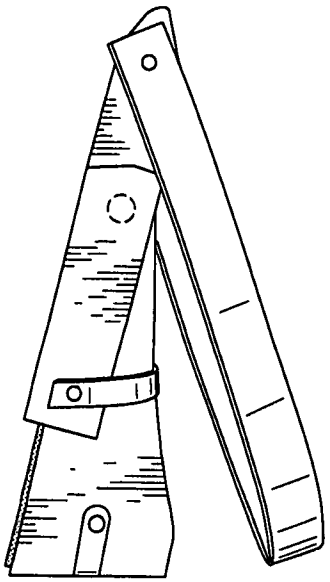
FIG. 14 is a perspective view as in FIG. 3 and provided with an additional base to back rest binder strap.

An item support shelf 52 extends between and affixed to the base sides and is spaced below the platform 22 and extends from the front of the base toward the rear of the base to provide a storage area 54. The area has a generally rectangular access opening 56 at the front of the base, and a generally rectangular closure panel 58 is pivotally mounted to and at the front lower portions of the base sides for allowing the closure panel to pivot upwardly from or downwardly to adjacent a base supporting floor 36 to open or close the access opening. Cooperating fastener means such as straps 62 affixed on the base sides and snap fasteners 60 affixed on the closure member are provided for retaining the closure member in a closed position. Shoulder means 64 is provided on the inner surface of the closure member for supporting a musical instrument such as a guitar 66 in an upright position when said closure member is shown in its open position (see FIG. 6) and resting on a supporting floor 36.

Felt or the like cushioning strips such as 68 are affixed to structures of the stand which come into contact with musical items. The upper portion of panel 58 is cavitated as at 70 to provide a toe hold 72 which a person can grip with the toe of his shoe and pull the panel down to its open position whereby, e.g., a guitarist can temporarily place his guitar in stand-by position as shown in FIG. 1.

Referring to FIGS. 1-3 and 11A, a table top 74 with front stop 75 is provided as a preferred embodiment of the present invention and is structured to be placed on top of an amplifier 76 and provides a flat horizontal surface 78 for supporting, e.g., an amplifier head 80. Wedge shaped sides 82 and 82A are cut to the proper angle to provide 74 with a horizontal item supporting posture. It is noted that storage area 54 is dimensioned to slidingly receive table top 74 for storage, e.g., during transport.

Figure 5A:
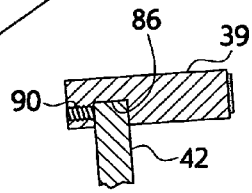
FIG. 5A is a cross-sectional view taken along line 5A-5A in FIG. 5.
Figure 5:
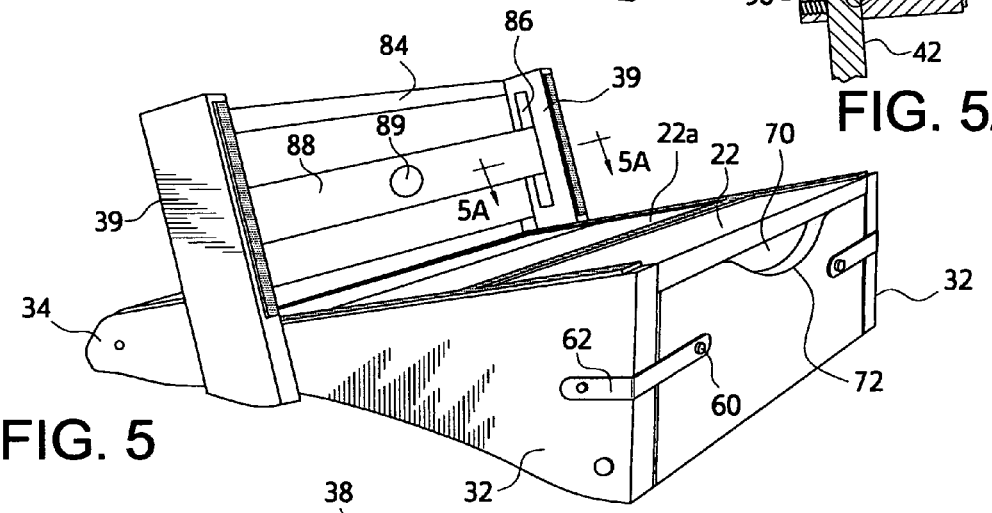
FIG. 5 is a perspective view of the present stand with the back rest pivoted to its open operative position and wherein an amplifier cooling fan is provided on the backrest.

Referring to the embodiment of FIGS. 5 and 5A, the back rest is constructed with a tie member 84 affixed to top portions of sides 39, wherein a slot 86 is provided in each member 84 for slidingly receiving cross member 88 on the back of which is mounted an electrical fan 89, preferably battery operated, for cooling the amplifier. Member 88 is locked into a desired up or down adjusted location in the slots by set screws 90 or equivalent means.

The straps (fastener means) preferably leather 62 and 92 preferably are provided with quick disconnect snap fasteners and the shoulder strap preferably is connected to the rear portions of the base sides by, e.g., Button shaped projections 94 on the sides and button holes 96 on the heavy leather carrying strap ends 98.

The invention has been described in detail with particular reference to preferred embodiments thereof, but it will be understood that variations and modifications will be effected within the spirit and scope of the invention.

We claim:

1. A collapsible stand for music amplifiers and the like, comprising a base having a pair of elongated laterally spaced, upstanding side members each having a bottom edge portion formed with a raised central section extending over a major portion of said bottom edge portions and thus adapted to form gaps between a stage floor and said bottom edge portions and to form a pair of downwardly extending front legs and a pair of shorter downwardly extending rear legs, a forward substantially planar platform having lateral ends connected to said side members and being slanted downwardly from front to rear at an angle to horizontal of up to to about 45°, a rearward spanner member having lateral ends connected to said side members, wherein said platform is spaced vertically above said front legs to provide an open space which is in communication with said gaps, a back rest pivotally mounted on said side members for being pivoted from a stored position adjacent a top of said platform to an open operative position at substantially 90° to said top said back rest having said side members affixed to opposite ends of a laterally extending back piece, the pivotal mounting structure for said back rest comprising side supports affixed to opposite ends of a laterally extending portion of said back rest wherein each support is pivotally mounted on an adjacent side member, cooperating stop shoulder means on said spanner member and on said back rest for positioning said back rest in said open operative position, and wherein all floor contacting leg portions terminate in a laterally extending ridge of substantially zero contact floor surface whereby interfering sound waves and structural vibrations generated and transmitted between an amplifier resting on said platform, the present stand and a stage floor, are markedly reduced, wherein said stop shoulder means on said spanner member is on a lateral top surface thereof and wherein said stop shoulder means on said back rest is on a lower edge portion of said back piece, wherein said top surface of said spanner member lies in a plane which is below said lower edge portion of said back piece when said back rest is in said open operative position, whereby when said back rest is pivoted forwardly and downwardly with said back piece positioned against said top of said platform the exposed upper surfaces of said back piece and said spanner member lie substantially in a common plane, wherein an item support shelf extends between and is affixed to said side members and is spaced below said platform and extends from the front of said base toward the rear of the base to provide a storage area, wherein said storage area has an access opening at the front of said base, wherein a closure panel is pivotally mounted to and at the front lower portions of said base sides for allowing said panel to pivot up or down, and wherein shoulder means is provided on an inside surface of said panel for supporting a musical instrument in a generally upright posture when said panel is in its open posture.

2. The stand of claim 1 wherein a toe hold shoulder is formed into an upper portion of said panel to allow a person to open down said panel with the toe of his or her shoe.

3. A kit for supporting music amplifiers and the like, said kit comprising a collapsible stand having a base having a pair of elongated laterally spaced, upstanding side members each having a bottom edge portion formed with a raised central section extending over a major portion of said bottom edge portions and thus adapted to form gaps between a stage floor and said bottom edge portions and to form a pair of downwardly extending front legs and a pair of shorter downwardly extending rear legs, a forward substantially planar platform having lateral ends connected to said side members and being slanted downwardly from front to rear at an angle to horizontal of up to to about 45°, a rearward spanner member having lateral ends connected to said side members, wherein said platform is spaced vertically above said front legs to provide an open space which is in communication with said gaps, a back rest pivotally mounted on said side members for being pivoted from a stored position adjacent a top of said platform to an open operative position at substantially 90° to said top, the pivotal mounting structure for said back rest comprising side support members affixed to opposite ends of a laterally extending portion of said back rest wherein each support member is pivotally mounted on an adjacent side member, cooperating stop shoulder means on said spanner member and on said back rest for positioning said back rest in said open operative position, and wherein all floor contacting leg portions terminate in a laterally extending ridge of substantially zero contact floor surface whereby interfering sound waves and structural vibrations generated and transmitted between an amplifier resting on said platform, the present stand and a stage floor, are markedly reduced, wherein said top surface of said spanner member lies in a plane which is below said lower edge portion of said back piece when said back rest is in said open operative position, whereby when said back rest is pivoted forwardly and downwardly with said back piece positioned against said top of said platform the exposed upper surfaces of said back piece and said spanner member lie substantially in a common plane, wherein an item support shelf extends between and is affixed to said side members and is spaced below said platform and extends from the front of said base toward the rear of the base to provide a storage area, wherein said area has an access opening at the front of said base, wherein a closure panel is pivotally mounted to and at the front lower portions of said base sides for allowing said panel to pivot up or down, and wherein shoulder means is provided on an inside surface of said panel for supporting a musical instrument in a generally upright posture when said panel is in its open posture, and wherein a toe hold shoulder is formed into an upper portion of said panel to allow a person to open down said panel with the toe of his or her shoe.

4. The kit of claim 3 wherein a table top structure is provided and comprises a substantially flat upper surfaced support member extending between and affixed at lateral ends thereof to a pair of opposing side members which, in elevation, are wedge shaped with the rear of each side member being higher than the front by the degree of the angle of slant of said platform whereby the upper surface of said support member is substantially horizontal.

5. The kit of claim 4 wherein said table top structure is stored within said storage area.

* * * * *